United States Patent [19]

Musgrave

[11] 4,442,962

[45] Apr. 17, 1984

[54] MAGAZINE HANGER

[76] Inventor: Daniel D. Musgrave, 8201 Caraway St., Cabin John, Md. 20818

[21] Appl. No.: 235,545

[22] Filed: Feb. 18, 1981

[51] Int. Cl.[3] ..... F41C 27/00

[52] U.S. Cl. ..... 224/255; D22/7; D22/14; 42/90; 220/230; 220/345; 224/101; 224/239

[58] Field of Search ..... 206/3; 224/101, 182, 224/239, 252, 255, 256, 268, 269; 42/87, 88, 90, 50, 18; 220/345, 350, 230; D22/7, 13, 14; 248/359, 360

[56] References Cited

U.S. PATENT DOCUMENTS

| | | | |
|---|---|---|---|
| D. 243,174 | 1/1977 | Sofinowski | D22/7 |
| 2,399,904 | 5/1946 | Baucum | 224/239 X |
| 2,730,262 | 1/1956 | Reams | 248/359 X |
| 2,902,196 | 9/1959 | Gray | 221/279 X |
| 3,087,270 | 4/1963 | Stoner | 42/50 |
| 3,180,528 | 4/1965 | Balint et al. | 248/359 X |
| 3,453,762 | 7/1969 | Fremont | 42/50 |
| 3,961,721 | 6/1976 | Gordon et al. | 220/230 |
| 4,110,552 | 8/1978 | Lombardi | 220/230 X |

FOREIGN PATENT DOCUMENTS

| | | | |
|---|---|---|---|
| 304379 | 2/1921 | Fed. Rep. of Germany | 42/88 |

*Primary Examiner*—William Price
*Assistant Examiner*—Gary E. Elkins

[57] ABSTRACT

A cartridge magazine hanger adapted for quick removal of a magazine therefrom using only one hand. The magazine is supported by engagement of at least one of its feed lips with a support on the hanger. The hanger can be attached to the clothing or equipment of the user or it can be mounted on a firearm, a vehicle, a boat, an aircraft, or a stationary structure. The hanger is also capable of serving as a cover to protect the feed mouth of the magazine against entry of extraneous matter, or against damage.

7 Claims, 7 Drawing Figures

MAGAZINE HANGER

The predominant trend in feed devices for firearms is the use of quickly exhangeable magazine. The user carries several of these so that when one is expended he can replace it and continue firing. In certain situations the time required to make the change is a matter of great significance. This is particularly true in military forces which engage in close combat. In such combat there will be instances in which a few seconds lost in making the exchange may be a matter of life or death for the user.

Magazines are frequently carried in pouches on the person of the user. Removal of a magazine from a pouch involves a delay and the distraction of the user's attention from the target.

It is an object of this invention to provide a magazine hanger for carrying a magazine in a manner which will permit the removal of said magazine quickly, using only one hand.

It is a further object to provide such a hanger from which removal of a magazine can readily be accomplished with a gloved hand.

It is a further object to provide such a hanger which will be economical to maufacture.

These and other objects of the present invention will be apparent upon reference to the following specifications, taken in connection with the accompanying drawings, in which.

Figure 1:
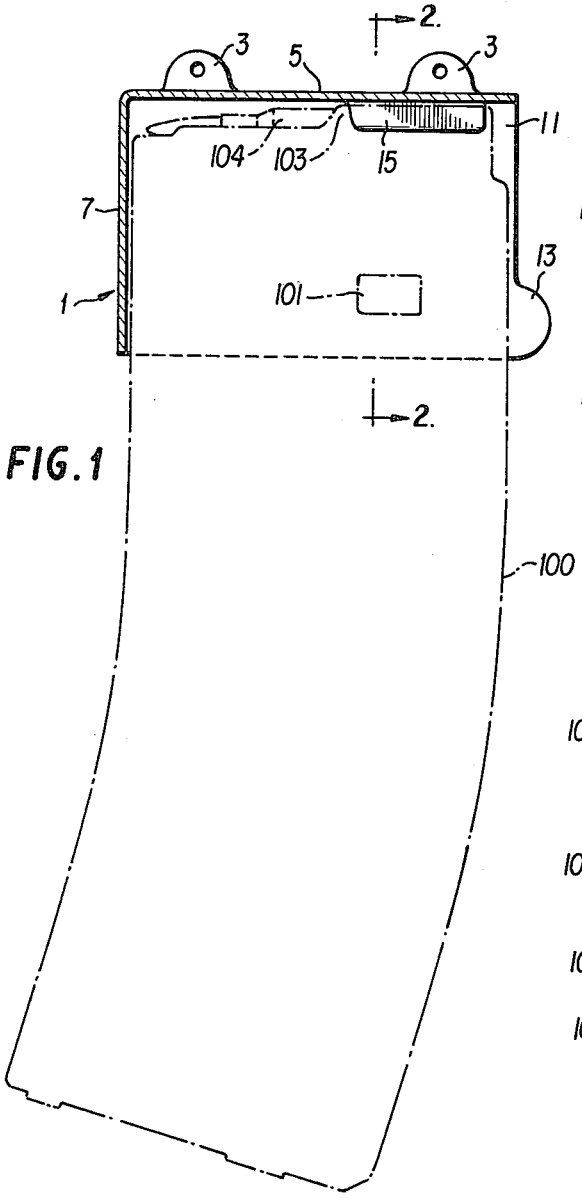
FIG. 1 is a longitudinal section of a magazine hanger with a magazine supported therein.

Referring to the drawings in detail, FIG. 1 discloses a magazine hanger generally indicated by numeral 1. Such a hanger can be made of metal, plastics, or any other suitable material. On top of the hanger are shown two loops 3 which are adapted for affixing the hanger to a supporting structure, which is not shown. The loops are merely examplary; any convenient mechanical device can be used to attach the hanger to a support, which might be the clothing, equipment, belt, or suspenders of a user.

The hanger includes a top 5, a front 7, and two sides 9 and 11. The bottom and the rear of the hanger are open, the rear being to the right of the viewer in FIG. 1.

A finger tab 13 extends from the rear of side 11. Although not visible in FIG. 1 a similar tab is formed at the rear of side 9.

Indicated in broken lines is a magazine 100 installed in the hanger. It has a slot 101 in its side near the viewer. The slot is used to engage the magazine in a firearm in the well-known manner.

Figure 2:
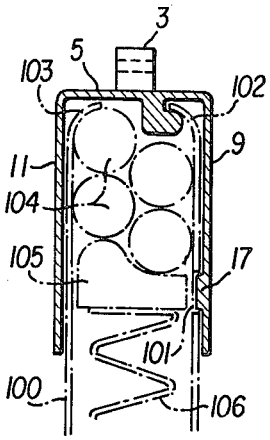
FIG. 2 is a cross section taken in the plane indicated by arrows 2—2 on FIG. 1.

The magazine also has typical feed lips 102 and 103. Lip 103 is only partly visible in FIG. 1 as it is somewhat concealed by lug 15 which extends down from top 5 of the hanger. In FIG. 2 it can be seen that the lug is so shaped as to be capable of being positioned partly under lip 102, to provide support for the magazine, in the hanger.

In FIG. 2 it may be seen that magazine 100 contains a plurality of cartridges 104. The cartridges are urged upward by a follower 105 which is biased by a spring 106.

Also to be seen in FIG. 2 is an inwardly projecting latch 17 on side 9 of the hanger. Latch 17 is so positioned as to be capable of entering slot 101 when magazine 100 is inserted into the hanger. Side 9 is intentionally made flexible to allow for this cooperation.

Figure 3:
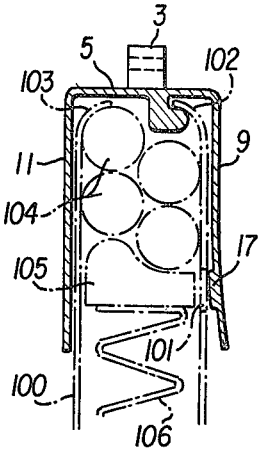
FIG. 3 is similar to FIG. 2 but a part has been moved.

Assuming the hanger to be supported on some suitable structure, by loops 3 or equivalant means, it is used as follows. A magazine 100 is inserted via the open rear of the hanger in the direction indicated by arrow A on FIG. 7. To do so it will be necessary to displace latch 17 as shown in FIG. 3. This can be done by finger pressure on tab 13 of side 9. As previously explained side 9 is made somewhat flexible.

Before inserting the magazine it will be necessary to ensure that the topmost cartridge is on the proper side to be compatible with the arrangement of the hanger. For FIG. 1, the proper side is the side near the viewer, as this leaves a space under lip 102 for lug 15 to enter. Obviously, during insertion of magazine 100, lip 102 will slide over a portion of a lug 15 and will engage therewith, so the space just under lip 102 must be vacant. If the topmost cartridge happens to be on the wrong side, removing it from the magazine will correct the situation.

When the magazine is pushed completely into the hanger in the direction of arrow A, latch 17 can enter slot 101, as shown in FIG. 2. This will prevent any relative sliding movement between lug 15 and lip 102. The magazine is therefore securely supported in the hanger.

To remove the magazine, it is grasped just below the hanger and the latch is disengaged by finger pressure against tab 13 on the appropriate side. The magazine is then drawn out in the direction indicated by arrow B on FIG. 7. The magazine will thus be properly held in the hand for quick insertion into a firearm.

Although not shown in the drawings, it would be possible to provide another lug, like 15 but oppositely oriented, to engage under lip 103. It would then be necessary to depress the top cartridge in the magazine when engaging the two lugs with the lips. This can be done readily because the entire stack of cartridges in the magazine can be depressed against the resistance of spring 106. Of course, this assumes that there is some empty space in the lower portion of the magazine to permit depressing the stack of cartridges, the follower, and the spring. With such an arrangement, it is immaterial on which side the top cartridge happens to be.

In FIG. 2 it can be noted that lug 15 supports magazine 100 and prevents if from moving downward toward the bottom of hanger 1. But the lug alone cannot prevent the magazine from rocking laterally on the lug as a pivot. To prevent such rocking sides 9 and 11 are so formed as to restrain lateral movement of the magazine relative to the lug. This will keep the lug properly engaged with lip 102. The word lateral is intented to mean along an axis substantially perpendicular to sides 9 and 11 as seen in FIG. 2.

If two supporting lugs are provided to engage both lips of the magazine in the manner described eariler, the restraint means may be necessary only to provide protection to a magazine in the hanger. Magazines must be protected against damages, particularly to the feed end, which is the upper end in the views. The feed end must also be protected against entry of extraneous matter. It will be noted that hanger 1 is capable of serving as a cover for magazine 100.

It should be pointed out that the drawings are examplary and that variations of detail can be made within the scope of this invention. For example, it is not necessary that latch 17 engage slot 101. It can be positioned so as to engage some other surface or part of the magazine. Of course, wherever positioned, it must also be adapated to be disengaged at the will of the user.

Figure 4:
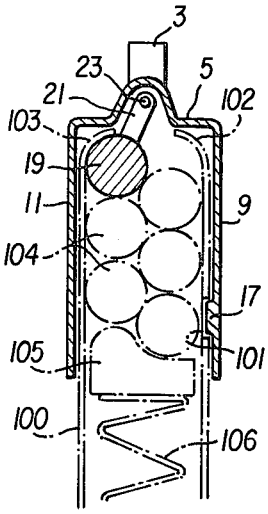
FIG. 4 shows an alternate component in a cross section like FIG. 2.
Figure 5:
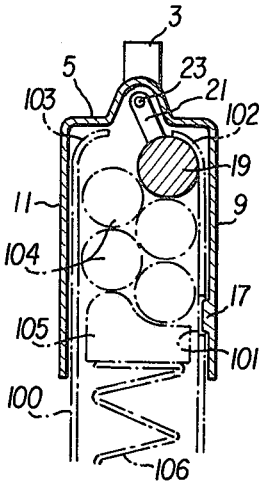
FIG. 5 is similar to FIG. 4 but a part has been moved.

FIG. 4 and FIG. 5 show an alternate arrangement for supporting a magazine in a hanger. A pendulum 19 having a neck 21 is pivotably suspended by any convenient method on an axis 23 located in a suitable recess in top 5. The bob of the pendulum is substantially cylindrical, with a length approximately equal to the length of the feed lips of a magazine with which it is to be used. Its diameter should be approximately the diameter of the cartridges used in said magazine.

Figure 7:
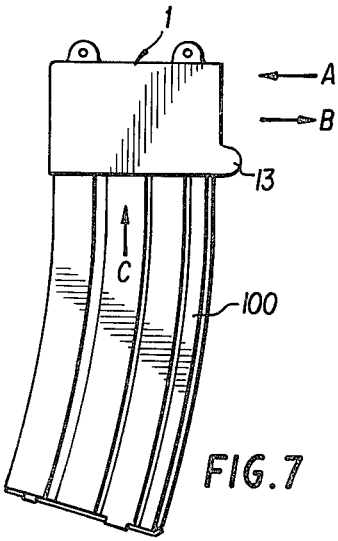
FIG. 7 is a sketch to indicate the direction of the movements involved in use of the hanger.

With this arrangement, a magazine is inserted into the hanger in the direction indicated by arrow C in FIG. 7. As the magazine is inserted, the bob of the pendulum will pass between lips 102 and 103 and will depress the stack of cartridges. This assumes that there is sufficient space in the lower part of the magazine to permit the stack to move the follower and compress the spring. If there is not sufficient space, one cartridge must be removed from the magazine.

When the bob of the pendulum has passed the lips it will be cammed laterally by the topmost cartridge in the magazine and will come to rest partly under one of the feed lips. In FIG. 4 it rests under lip 103; the other possibility is shown in FIG. 5 where it rests under lip 102. In both situations, the bob of the pendulum supports the magazine within the hanger.

The bob of the pendulum is retained in position under either feed lip in the same manner as cartridges are so retained in feeding a firearm. The upward pressure of the stock of cartridges will tend to seat the bob firmly under either lip. To remove a magazine from the hanger it is drawn out in the direction indicated by arrow B in FIG. 7. The cylindrical bob will then slide out from engagement with the feed lip in the same manner that a cartridte slides out from such engagement when it is rammed into the barrel of a firearm. Of course, the neck of the pendulum must be so configured and dimensioned as to clear the feed lips of a magazine used with the hanger. To facilitate the insertion of a magazine into the hanger the suspension of the pendulum can include bias means which will tend to cause it to seek a central position between sides 9 and 11 of the hanger. This would ensure that the bob passes properly between the feed lips of the magazine during such insertion.

Figure 6:
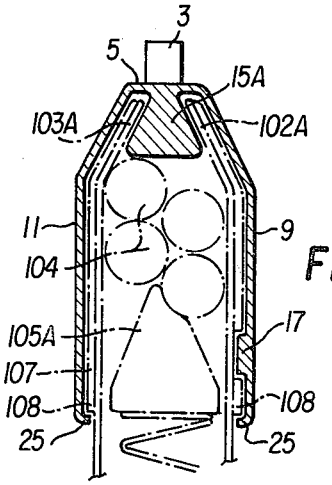
FIG. 6 shows another alternate component in a cross section like FIG. 2.

FIG. 6 shows a cross-section of a hanger intended to support a magazine with flat converging lips 102A and 103A. In this type of magazine the two columns of cartridges are forced into one column as then approach the converging lips. The space between the tops of the lips is slightly less than the diameter of a cartridge.

As it is not possible to provide distinct support under one lip, a lug 15A, of wedge shape, is used. The wedge is contoured so as to be a snug fit between the lips, whereby it can support a magazine in the hanger. The wedge is affixed to top 5 in any convenient manner.

With this arrangement a magazine is inserted into the hanger in the direction indicated by arrow A on FIG. 7. While this is being accomplished the stack of cartridges in the magazine must be depressed, using some simple tool such as a srewdriver. If there is not sufficient space in the lower part of the magazine to permit the stack to move the follower and compress the spring, one or more cartridge must be removed from the magazine.

This type of magazine is frequently made with a reinforcing collar, such as 107, over its feed end. The ends 108 of this collar are a convenient place to provide additional support for the magazine. This is accomplished by forming the ends 25 of sides 9 and 11 so as to be capable of engaging under the ends of the collar. The follower 105A is adapted to rise between converging lips 102A and 103A and is of a type well-known in the art.

It should be understood that the described embodiments are exemplary and that variations of construction are possible. A hanger can also be designed to accept slightly different models of magazines. This can be accomplished by careful engineering of the hanger as a product, and by making it flexible to allow for slight differences in dimensions. For use with steel magazines the hanger can be magnetized to assist in keeping the magazine properly engaged with the support means. Various well-known types of loops, swivels, hooks, or other hardware can be used to affix the hanger to a supporting structure as hereinbefore stated. Some of these attaching devices are now made of plastics, not being actual metal hardware.

There is thus disclosed a simple hanger for a cartridge magazine, adapted for quick and easy removal of a magazine therefrom. Such a hanger will be useful both with existing, and with future magazines.

What I claim is:

1. A cartridge magazine hanger comprising a casing to fit over the feed end of the magazine, said casing having a top wall and at least two sidewalls, said top wall having releasable means located on the inner surface thereof to engage at least one lip of the magazine.

2. A cartridge magazine hanger as set forth in claim 1 wherein said releasable means is adapted for pivoting so as to selectively engage either of two feed lips of said magazine.

3. A cartridge magazine hanger as set forth in claim 1 which also includes disengageable latch means positionally adapted to prevent said feed lip from moving out of engagement with said releasable means for supporting a magazine.

4. A cartridge magazine hanger as set forth in claim 1 wherein said sidewalls are resilient.

5. The magazine hanger of claim 1 wherein said means is integral with said casing.

6. The magazine hanger of claim 1 wherein said casing is of magnetic material.

7. The magazine hanger of claim 1 including means on the exterior surface for hanging on a support.

* * * * *